US006225609B1

(12) United States Patent
Imanari et al.

(10) Patent No.: US 6,225,609 B1
(45) Date of Patent: May 1, 2001

(54) COILING TEMPERATURE CONTROL METHOD AND SYSTEM

(75) Inventors: Hiroyuki Imanari, Chiba; Kozo Yamahashi, Yokohama; Hideho Goudo, Fuchu, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/453,398

(22) Filed: Dec. 3, 1999

(30) Foreign Application Priority Data

Dec. 3, 1998 (JP) ..... 10-344627

(51) Int. Cl.[7] ..... H05B 1/02

(52) U.S. Cl. ..... 219/494; 486/483; 164/154.6; 164/455; 72/12.2

(58) Field of Search ..... 219/483, 486, 219/494; 72/9.1, 11.7, 12.2; 164/455, 479, 481, 485, 148, 472.04, 153, 159, 154.6

(56) References Cited

U.S. PATENT DOCUMENTS 3,589,160 * 6/1971 Gruver et al. ..... 72/201
4,648,916 * 3/1987 Morita et al. ..... 148/128
5,541,832 * 7/1996 Nakajima et al. ..... 364/148
5,960,657 * 10/1999 Anbe et al. ..... 72/9.1
5,988,259 * 11/1999 Welker et al. ..... 164/455
6,019,159 * 2/2000 Roder et al. ..... 164/455

FOREIGN PATENT DOCUMENTS 8-90036 4/1996 (JP) .
10-5845 1/1998 (JP) .

* cited by examiner

*Primary Examiner*—Mark Paschall
(74) *Attorney, Agent, or Firm*—Foley & Lardner

(57) ABSTRACT

To cool a strip rolled by a hot rolling mill using cooling banks installed on the run out table at the delivery side of the hot rolling mill, and to control the strip temperature in front of coiler to a preset target temperature, the strip is conceptually divided into segments or cooling units which have a length equal to the length of a single cooling bank, the temperatures of the segments are predicted, and the cooling banks are so controlled as to have the prediction temperatures coincide with preset target temperature. In this case, a feed-forward control of the cooling water flow rate in the cooling banks are made so that predictive temperatures on a real time basis of the temperatures of the cooling segments at the time when the segments are staying in the respective cooling banks coincide with the target temperatures.

13 Claims, 9 Drawing Sheets

COILING TEMPERATURE CONTROL METHOD AND SYSTEM

BACKGROUND OF THE INVENTION

1. Field of the Invention

This invention relates to a control method for obtaining a desired coiling temperature by way of cooling a rolled strip in the hot rolling process of metals and its system.

2. Related Background Art

Quality control in hot sheet metal rolling process is largely divided into two following controls: (1) Product size control such as strip thickness control for controlling rolled strip thickness in its lateral center, strip width control, strip crown control for controlling lateral width distribution, and flatness control for controlling strip lateral elongation, and (2) temperature control of rolled strip. The temperature control of rolled strip includes two following controls: (1) Temperature control for controlling the temperature of rolled strip at the delivery side of finishing rolling mill and (2) coiling temperature control for controlling the temperature of the rolled strip in front of the coiler.

Generally, in a hot rolling mill, a heating furnace, a roughing mill, a finishing mill, a run out table (ROT) on which a cooler is installed and a coiler are serially arranged. Typical temperatures of strips are: 1200 to 1250 degree C. at the delivery side of the heating furnace, 1100 to 1150 degree C. at the delivery side of the roughing mill, 1050 to 1100 degree C. at the entry side of the finishing mill, 850 to 900 degree C. at the delivery side of the finishing mill, and 500 to 800 degree C. at the coiler. In almost all cases, the strength, toughness and other properties of rolled strips depend on positive cooling to which the strips are subjected while the strips come out from the finishing roll and reach the coiler. Therefore, coiling temperature control is extremely critical for final material quality.

FIG. 10 is a schematic block diagram showing a typical coiling temperature controlling system according to the prior art, inclusive of applications: In the drawing, after a stripping sheet 1 is finishing rolled into the strip 1 at the finishing mill 4, the strip 1 is transported on the ROT and finally coiled by the coiler 6 while guided by the pinch roll 5. The finisher delivery pyrometer (FDT) 2 is provided at the delivery side of the finishing mill 4, and the coiling pyrometer (CT) 3 is provided at the entry side of the pinch roll 5. On the ROT 10 is installed a cooling device consisting of n pieces of cooling units (also collectively referred to as cooling bank) 7*a*, 7*b*, 7*c*, . . . . The cooling units respectively inject cooling water to cool the strip 1. In this connection, in the drawing ROT 10 is drawn like a straight line, but actually a number of rolls are arranged for rotation, to transport the strip 1.

The valves installed in the cooling banks 7*a*, 7*b*, 7*c*, . . . for controlling cooling water flow rate may be closing valves or flow control valves. But, the two or three cooling banks nearest to the coiling pyrometer 3 may be flow rate controllable valves or a number of small flow rate closing valves to have finer feedback control, which is to be described in more detail later.

The coiling temperature controller 24 is installed to control the opening and closing of each valve at the cooling banks 7*a*, 7*b*, 7*c*, . . . to control cooling water flow rate. To the coiling temperature controller 24 are fetched the temperature indications of the finishing delivery pyrometer (FDT) 2 and the coiling pyrometer (CT) 3, output pulses of the pulse generator 9*a* connected the driving motor of the finishing roll 4 and the pulse generator 9*b* connected the coiler 6, as well as calculational information for setting the finishing roll 4 which is made by the finishing roll setting calculation means 8.

The coiling temperature (CT) control system 24 is divided into the following two subsystems from the viewpoint of its purpose: (1) The first subsystem which determines which cooling banks 7*a*, 7*b*, 7*c*, . . . is or are used for cooling so that the CT should coincide with the target coiling temperature $T_{CT}^{AIM}$, mainly based on the temperature measurement $T_{FD}^{ACT}$ of the strip 1 (detected by FDT 2) locating right thereunder, and (2) the second subsystem which corrects a deviation of actual coiling temperature $T_{CT}^{ACT}$ from the target coiling temperature $T_{CT}^{AIM}$.

The first subsystem consists of the material temperature prediction means 13, the material tracking means 14, the cooling water flow rate setting means 22 and the temperature model learning means 23, while the second subsystem consists of the target temperature correction means 16, the feedback control means 17 and the cooling water flow rate changing means 21.

Now, description will be made for the CT control system 24 according to the prior art as follows:

According to the prior art, a total length of rolled strip 1 is divided into a number of conceptual segments as a material cooling unit. The performance of the cooling banks 7*a*, 7*b*, 7*c*, . . . are decided, so that, at the point of time when a certain segment of the rolled strip passes a specific rolling stand (e.g., the (m−j)th stand) of the finishing rolling mill 4, the segment temperature should become the target coiling temperature $T_{CT}^{AIM}$, which is calculated based on the temperature measurement $T_{FD}^{ACT}$ of the strip 1 locating right under FDT 2 and the setting calculational information of the rolling mill setting calculation means 8. Therefore, by counting the output pulses of the pulse generators 9*a* and 9*b*, the material tracking means 14 detects the location of the strip 1 on ROT 10 at any state at the time of (1) "before the head end of the strip 1 reaches the coiler 6", (2) "while coiling the strip 1", and (3) "after the tail end of the strip 1 passes through the finishing mill 4".

In this connection, tracking of the strip 1 is not limited to the method which counts the output pulses of the pulse generators 9*a* and 9*b*, but, for example, another method such as provision of material sensor midway of ROT 10 can be used.

The temperature model learning means 23 provides necessary information for prediction of material temperature to the material temperature prediction means 13, based on the temperature measurement $T_{FD}^{ACT}$ of the strip detected by FDT 2 and the actual coiling temperature $T_{CT}^{ACT}$ to be detected by CT 3.

At a timing when the k-th strip segment from the head end of the strip 1 just reached the (m−j)th stand of the finishing mill 4, the material temperature prediction means 13 predicts the probable material temperature which takes place when the k-th segment is to be applied with cooling water at the cooling bank 7*a*. The cooling water flow rate setting means 22 judges whether the material temperature predicted at the (m−j)th stand can achieve the target coiling temperature $T_{CT}^{AIM}$. When "YES", only the cooling bank 7*a* is used. When "NO" or higher than target, the downstream cooling bank 7*b* is used together. Then, again, the material temperature is estimated by the material temperature prediction means 13. The above-described operation is repeated until the target coiling temperature $T_{CT}^{AIM}$ is obtained.

In this connection, why these calculations must be done at the timing when the segment just reached the (m−j)th stand of the finishing mill 4 is as follows: In general, an opening or closing of the valves or a flow rate change to be made in the cooling bank controller would have dead time or response delay, or the calculational operation to be done therein would take much time, thereby necessitating the compensation for these delays. Therefore, when these loss times can be minimized, a referenced stand such as the (m−j)th stand can be brought to more downstream stand, expecting more accurate coiling temperature.

Thus, when the cooling water flow rate to be applied to a reference segment is determined, and when the referenced segment reached the i-th stand while the material tracking means 14 was keeping the track of the segment, the desired cooling water flow can be supplied.

Then, when the cooled k-th segment reached just under the CT 3, the feedback control means 17 determines a deviation of $T_{CT}^{ACT}$ from $T_{CT}^{AIM}$, and adjusts the flow rates at e.g., "(n−1)"th and "n"th cooling banks so as to minimize the deviation.

When the deviation of $T_{CT}^{ACT}$ from $T_{CT}^{AIM}$ is significant, the target temperature correction means 16 provisionally changes the target temperature. For example, when the measured $T_{CT}^{ACT}$ is higher than $T_{CT}^{AIM}$, the target temperature is purposefully lowered for a while. A valve opening triggered by the cooling water flow rate changing means 21 for following the lower target temperature can accelerate the sooner approach of $T_{CT}^{ACT}$ to the original target temperature $T_{CT}^{AIM}$.

Before the rolled strip enters ROT 10, the coiling temperature control system according to the prior art determines how much and when the cooling water should be supplied to the segments. After the determination, if there should happen a change in the temperature or transfer speed of a segment at the delivery side of the finishing mill (that is at the entry side of the ROT) or a large disturbance, the controllability may deteriorate significantly. Preventive actions against such deterioration of coiling temperature controllability are known as e.g., "Hot Rolling Mill Coiling Temperature Control" specified in JP 08090036 A and "Temperature Control Method for Hot Rolled Strip" specified in JP 10005845 A.

Among the two, the former intends to control a temperature change of the strip at the delivery side of the finishing rolling mill and a change in coiling temperature due to a change in transfer speed of the strip separately, while the latter determines the mean value of the preset speed pattern and a changed speed pattern when the strip transfer speed is changed, to recalculate the necessary cooling water flow rate. Such being the case, the coiling temperature control method according to the prior art is very insensible to an unexpected speed or a change in the entry side temperature, thus resulting in a failure to cover such insensibility.

On the other hand, in the temperature model, the locations on the ROT 10 at which strip or segment temperature can be measured are limited to e.g., the delivery side of the finishing rolling mill 4, the entry side of the coiler 6 and rarely midway of the ROT 10, so that it is qualitatively known that the lower the temperature, the higher the cooling effect. With respect to the learning of temperature model, however, it can have only one or a few learning terms at the full length of the ROT 10, thus resulting in a failure to learn the cooling characteristics at the upstream and downstream sides separately.

In a case of thick strips, the surfaces may be fully cooled, but the inside cannot be sufficiently cooled, thus causing a higher mean temperature in the thickness direction. To our regret, the surface temperature is only one measurable by way of pyrometers, so that temperature calculations based on a model cannot show good agreement with actual temperatures to be used in learning course, thus resulting in a poor temperature prediction accuracy. Further, even in the case where a mean temperature in the thickness direction is calculated, a difference equation is solved by repetitive calculations, so that sometimes the load on the computer became significantly large.

SUMMARY OF THE INVENTION

In view of the aforementioned problems, this invention intends to provide a coiling temperature control method and its system which can minimize disturbance influence.

Further, the invention intends to provide a coiling temperature control method and its system which can produce a high accuracy of coiling temperature control even when an unexpected change should take place in the strip transfer speed.

Furthermore, the invention intends to provide a coiling temperature control method and its system which can obtain an accurate average temperature in the thickness direction, thereby enhancing the temperature controllability.

Still more, the invention intends to provide a coiling temperature control method and its system which can mechanically correct the thermal conductivity depending on material temperature.

To achieve these above-described purposes, the coiling temperature control method according to the invention, which is used to cool a strip rolled by a hot rolling mill by way of a plurality of coolers installed on the run out table at the delivery side thereof, so as to control the temperature of a strip advancing in front of the coiler to a predetermined target temperature, the method comprises the steps of;

conceptually dividing the rolled strip to form several cooling units or segments in the direction of strip advancing in serial cooling banks consisting of a plurality of coolers;

predicting the temperatures of the strip segments; and controlling the predicted temperatures so as to coincide with predetermined target temperatures.

Further, the coiling temperature control system according to the invention, which is used to cool a strip rolled by a hot rolling mill using a plurality of coolers installed on a run out table at the delivery side of the hot rolling mill to control the temperature of the strip in front of the coiler to a predetermined target temperature, the system comprising:

temperature prediction means for predicting temperatures of rolled strip cooling units or segments which are formed by conceptually dividing the rolled strip in the direction of strip advancing in serial cooling banks consisting of a plurality of coolers, and temperature control means for controlling the temperatures of every strip cooling segment predicted by the temperature prediction means so as to coincide with a predetermined target temperatures.

It is advisable that the coiling temperature control system according to the invention further includes strip temperature prediction means for predicting on a real time basis the temperatures of the strip cooling segments at the time when the strip cooling segments locate in the relevant cooling banks, and feed-forward control means for controlling water flow rates of the cooling banks so that the temperatures predicted by the temperature prediction means coincide with the preset target temperatures.

The material temperature prediction means predicts a such a temperature as to compensate a distance of the segments advancing in a response delay time duration elapsed before the cooing banks reach respective pre-ordered flow rates, and sets the predicted compensation temperature to the feed-forward control means.

A temperature model for describing the cooling of a rolled strip is used to predict the temperatures of the strip cooling units. The temperature model includes at least of heat conduction terms, among a heat conduction term from the strip to cooling water, a heat buildup term due to phase transformation, a heat radiation term from the strip, and a heat conduction term to peripheral bodies except cooling water from the strip. The temperature of the strip to be used in the temperature model can use a representative or average temperature of the strip in the thickness direction thereof, which is obtained from an analytical solution of a first-dimensional non-steady thermal conduction equation.

As parameters which can describe thermal conduction coefficient to be used as thermal conduction term from the strip to the cooling water in the temperature model, at least cooling water flow rate, cooling water temperature, and the transfer speed and temperatures of the strip segments are included.

The temperature model to be used in the strip temperature prediction means is subject to correction by learning term calculated based on the actual data to be obtained from control operations. As the learning term, at least one of a coil-to-coil learning term and a within-lot learning term is calculated.

The learning term segregates the thermal conductivity of the material cooling segments for each cooler or for each cooler unit group into which several cooler units are handled as a package. Learning is conducted for the thermal conductivity of the strip cooling unit for every segregation.

The coiling temperature control system according to the invention may further include a temperature target setting means for tentatively giving the target temperatures set for every strip cooling segment as the actual temperatures just in the cooler units, and then recalculates the target temperatures as a function which includes a total temperature reduction due to cooling factors other than water-cooling which is obtained by integration from the coiling pyrometer side toward upstream side, and the coiling target temperature.

At the initial setting, the coiling target temperature for the purpose of control is set identical to a coiling target temperature proper to a product or strip. But, the coiling temperature control system according to the invention may further include temperature target correction means, the temperature target correction means, when comparison shows that the coiling target temperature for purpose of control is higher than the actual temperature of the strip cooling segment transferred down to the coiling pyrometer, increasing the coiling target temperature for purpose of control, while, in a lower case, decreasing the coiling target temperature for purpose of control.

The coiling temperature control system according to the invention may further install at least one of intermediate pyrometer for measuring the material temperature in midway on the run out table, and may incorporate prediction temperature correction means for correcting the predicted material temperatures, using the deviation of actual measurements of the intermediate pyrometer from the predictive temperature of the strip at the intermediate pyrometer.

At least in the case of a rolling strip with a particular thickness, mean temperatures in the thickness direction of a rolled strip which are obtained by analytically solving a first-dimensional non-steady thermal conduction equation may be used as actual material temperatures measured by respective pyrometers.

DESCRIPTION OF THE PREFERRED EMBODIMENT

Figure 1:
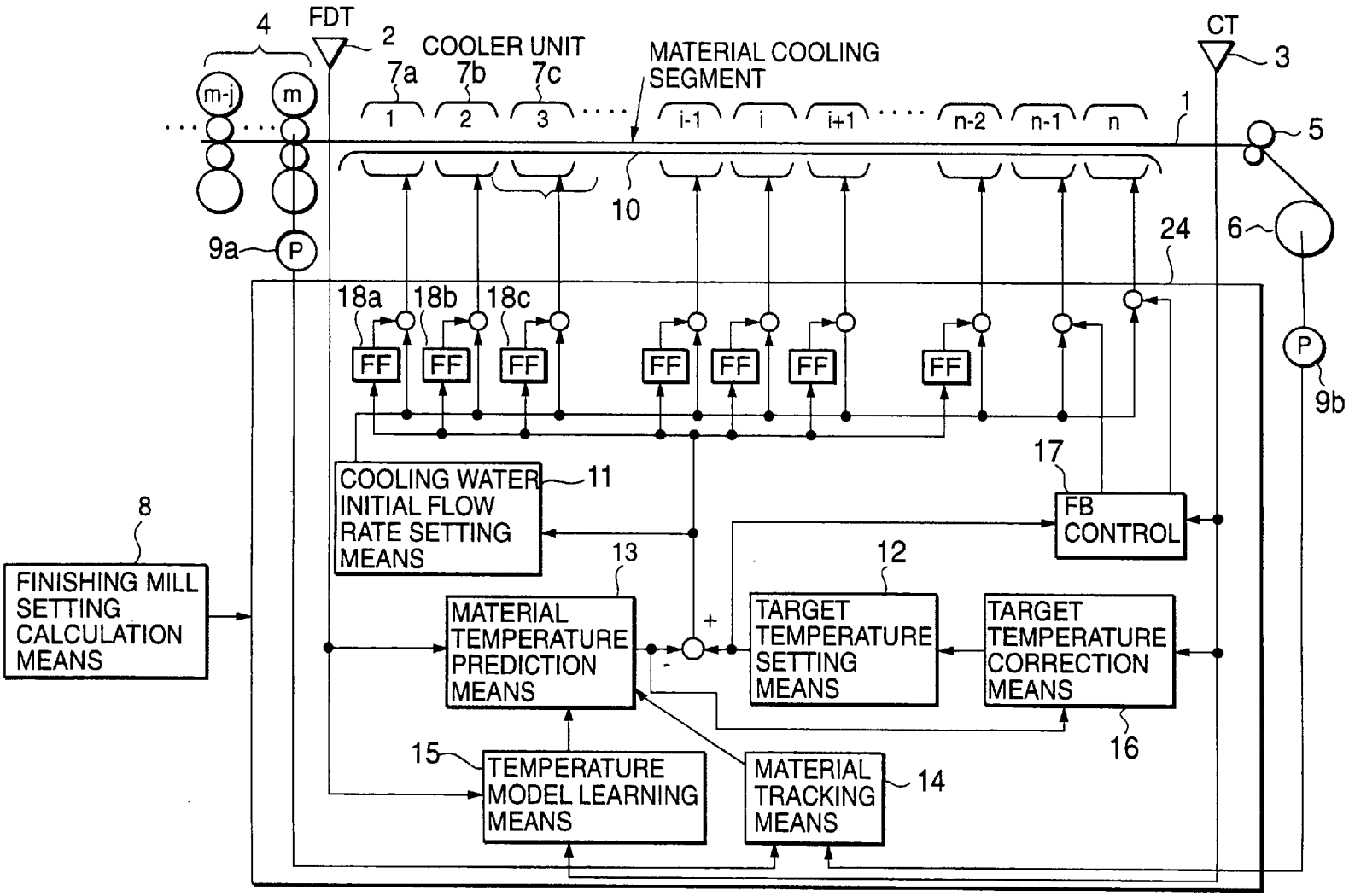
FIG. 1 is a schematic block diagram showing one embodiment of the temperature control system to carry out the temperature control method according to this invention, along with an application device.
Figure 10:
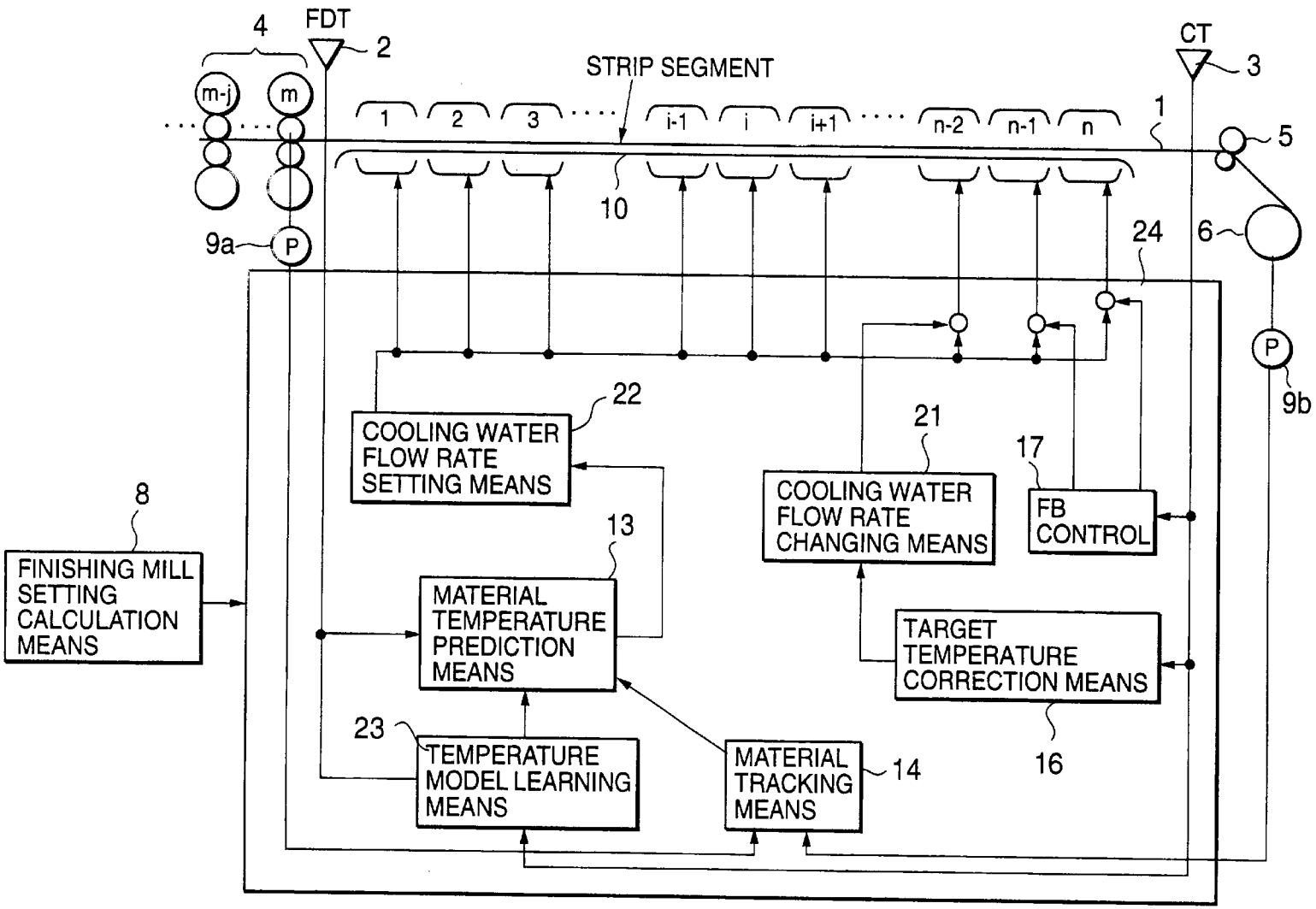
FIG. 10 is a schematic block diagram showing the temperature control system according to the prior art, along with an application device.

Referring to the preferred embodiments shown in the attached drawings, detail description will be made for the present invention:

FIG. 1 is a schematic block diagram showing one embodiment of the coiling temperature control system according to the present invention:

In the drawing, the same elements as ones used in FIG. 10 showing the prior art are attached with the same signs, thus omitting their description. In FIG. 1, a target temperature setting means 12 is preferentially added to the prior art, so that an output of the target temperature correction means 16 is supplied to the target temperature setting means 12. The temperature model learning means 23 according to the prior art is replaced by a temperature model learning means 15 (to be described in detail later). Deviations of the predictive temperatures predicted by the material temperature prediction means 13 from the output target temperatures of the target temperature setting means 12 are supplied to the cooling water initial flow rate setting means 11 and feed-forward control means 18*a*, 18*b*, 18*c*, . . . installed in correspondence to the cooling banks 7*a*, 7*b*, 7*c*, . . . In this case, the valves respectively supplying cooling water to the cooling banks 7*a*, 7*b*, 7*c*, . . . consist of flow rate adjusting valves, so that the amount of water supply is initially set by the cooling water initial flow rate setting means 11, and the feed-forward control means 18*a*, 18*b*, 18*c*, . . . readjusts the amount of supply.

Now, first, the general operation of the embodiment thus configured will be roughly described, and then the operations of the individual constituting components will be described in more detail:

First, before a rolled strip 1 is entering onto the ROT 10, the strip 1 is conceptually divided into a number of material cooling units or segments respectively with a suitable same length. Then, the material tracking means 14 counts the pulses generated at the pulse generators 9*a* and 9*b*, so as to follow the track of material cooling segments until respective segments pass through the CT 3.

The cooling water initial flow rate setting means 11 calculates to make a cooling pattern which can achieve the target coiling temperature for the material cooling segment (located at the head end of the strip 1) whose length is equivalent to a distance how far the strip 1 advances during the response delay time of the valves, thus presetting a necessary spray rate of cooling water.

The material temperature prediction means 13 inputs (to the temperature model) a temperature of the strip at the delivery side of the finishing rolling mill (hereinafter referred to TFD) measured by the finishing delivery pyrometer 2. At the same time, the material temperature prediction means 13 calculates material temperature prediction values just under the cooler units using the temperature model, so as to compensate the response delay times of the valves in the cooler units 7*a*, 7*b*, 7*c*, . . . . The temperature model in the material temperature prediction means 13 is corrected by the temperature learning means 15. More particularly, the temperature learning means 15 evaluates a deviation of predicted coiling temperature from actual coiling temperature, and calculates a temperature model learning term which is used for correction so that the predictive temperature should come nearest to the actual temperature.

To obtain desirable material quality of a strip 1, the target temperature setting means 12 establishes a cooling temperature pattern for the material cooling segments which passes through the cooler units. The target temperature correction means 16 intentionally but tentatively changes the on-going target temperature in accordance with the deviation of actual temperature from the target temperature, so that a sooner approach of actual temperature to the original target temperature can be expected.

The feed-forward control means 18*a*, 18*b*, 18*c*, . . . evaluate the deviation of the temperature predictions of the material segments which are arriving (under the cooler units) valve's response delay time later than the time calculated by the material temperature prediction means 13 from the target temperatures of the respective material cooling segments given by the target temperature setting means 12, so as to minimize the temperature deviation by operating the valves for the respective cooler units.

In this case, the cooler unit is classified by the mechanical configuration. Here, an assembly in which one independent closing valve is combined with one or more flow rate adjusting valves is regarded as a package. For example, a cooler to which one closing valve is attached to the header, and three nozzles project out from the header is regarded as a cooler unit in block or as a whole.

In this connection, one material cooler unit should correspond to one conceptual segment of the strip so that the length of each segment be equal to the spacing of the adjacent material cooler units.

Now, detailed description will be made for the temperature model learning means 15 and the feed-forward control means 18*a*, 18*b*, . . . :

The temperature model for representing heat outgoing and incoming from and to a rolled strip can be represented as following expression (1):

$$\frac{dT}{dt} = -\frac{2\sigma\varepsilon}{c\rho h}\{(T+273)^4 - (T_a+273)^4\} - \frac{\alpha_c}{c\rho h}(T-T_a) - \frac{\alpha_U+\alpha_L}{c\rho h}(T-T_W) - \frac{\alpha_\lambda}{c\rho h}(T-T_H) + \frac{Q_T}{c\rho} \quad (1)$$

where

T: material temperature t: Time h: strip thickness

ε: emissivity c: specific heat of material

ρ: material density $T_a$: air temperature $T_W$: cooling water temperature $T_H$: table roll temperature σ: Stefan-Boltzmann constant $\alpha_c$: coefficient of heat transfer due to convection to ambient air $\alpha_U$: coefficient of heat transfer at the top surface of strip $\alpha_L$: coefficient of heat transfer at the bottom surface of strip $\alpha_\lambda$: coefficient of heat transfer to table roll $Q_T$: phase transformation rate.

The first term to fourth term in the right side in equation (1) show heat removal from the strip. The first term is due to heat radiation from the strip, the second term due to convection to ambient air, the third term due to heat conduction from the strip to cooling water, and the fourth due to heat conduction from the strip to table roll, and the fifth term represents heat generation due to phase transformation inside the strip. The left side in equation (1) shows a change of material temperature per time, or changing rate of material temperature.

For simplification of the equation, parameters other than $\alpha_U$ and $\alpha_L$ are assumed to be constant, or reference values for them are prestored in the table. For example, since specific heat "c" of material depends on material temperature, "c" values are prestored in the areas in the table segmented by temperatures. $\alpha_U$ and $\alpha_L$ are dominant factors of coolant water flow rate, and may be regarded as taking such models (2) and (3) as follows:

$$\alpha_U = W_U A_1 h^{A2} \exp\{-A_3(T-T_W)\}\left(\frac{T_{W0}}{T_W}\right)^W \left(\frac{V_a}{V_{BASE}}\right)^v \quad (2)$$

$$\alpha_L = K_L W_L A_1 h^{A2} \exp\{-A_3(T-T_W)\}\left(\frac{T_{W0}}{T_W}\right)^W \left(\frac{V_a}{V_{BASE}}\right)^v \quad (3)$$

where $W_U$: flow density of upper side cooling water $W_L$: flow density of lower side cooling water $A_1$, $A_3$:coefficient A2, W, V: coefficient $T_{WO}$: reference value of cooling water temperature $V_a$: actual transfer speed of strip $V_{BASE}$: base transfer speed of strip $K_L$: ratio of cooling water efficiency (when sprayed from below) as compared to from above (Generally, spraying from below is lower in efficiency)

$W_U$ and $W_L$ can be given by following expressions (4) and (5):

$$W_U = \frac{F_{Ui}}{B_{BNK} \cdot L_{BNK}} \tag{4}$$

$$W_L = \frac{F_{Li}}{B_{BNK} \cdot L_{BNK}} \tag{5}$$

where $F_{Ui}$: spray flow r ate from upper side of the ith bank $F_{Li}$: spray flow rate from lower side of the ith bank $B_{BNK}$: width of bank $L_{BNK}$: length of bank.

Setting of cooling water flow rate and other necessary values of parameters can determine the right side of the equation (1), so that material temperature changing with time elapse can be calculated by way of numerical integration of the equation (1). Therefore, making temperature predictions for every control timing can reflect a change of time interval staying in the cooling bank to the change of material temperature, so that good accuracy can be expected even if strip transfer speed should be suddenly changed.

The feed-forward control means 18*a*, 18*b*, 18*c*, . . . perform following operations. First, the target temperature $T_i^{REF}$ of the i-th bank is given from the target temperature setting means 12 (to be described later). Then, numerical solution of the equation (1) can determine the temperature $T_i^{CAL\text{-}FF}$ of the i-th bank. Because the inverse operation of the equation (1) is difficult, the cooling water flow rate at the i-th bank is calculated using following approximations (6), (7), (8) and (9).

$$\Delta T = T_i^{REF} - T_i^{CAL-FF} + \Delta T_{OTHERS} \tag{6}$$

$$\frac{\Delta T_{OTHERS}}{T_{BNKi}} = -\frac{2\sigma\varepsilon}{c\rho h}\{(T+273)^4 - (T_a+273)^4\} - \frac{\alpha_c}{c\rho h}(T-T_a) - \frac{\alpha_\lambda}{c\rho h}(T-T_H) + \frac{Q_T}{c\rho} \tag{7}$$

$$F_{ULi}^{REF} = K_{FFi}\frac{c\rho h \times \Delta T}{T_{BNKi}\phi(T_i^{CAL-FF} - T_W)(f_U(z) + f_L(z))} \tag{8}$$

$$F_{Ui}^{REF} = F_{Li}^{REF} = F_{ULi}^{REF} \tag{9}$$

where $F_{ULi}^{REF}$: reference value of cooling water flow rate at the i-th bank $F_{Ui}^{REF}$: reference value of cooling water flow rate at the upper side of the i-th bank $F_{Li}^{REF}$: reference value of cooling water flow rate at the lower side of the i-th bank $T_{BNKi}$: time length needed for passing the i-th bank(length of the i-th bank/material transfer speed)

$\phi$: heat transfer coefficient learning term $K_{FFi}$: the i-th feed-forward gain (The value can be fetched referring to a table segmented by steel type, thickness and others)

$f_U(z)$ : terms other than upper side cooling water flow rate in the heat transfer equation $f_L(z)$ : terms other than lower side cooling water flow rate in the heat transfer equation.

In this connection, $f_U(z)$ and $f_L(z)$ are represented by following expressions (10) and (11):

$$f_U(z) = \left(\frac{1}{B_{BNK} \cdot L_{BNK}}\right) \times \left[A_1 h^{A2} \exp\{-A_3(T-T_W)\}\left(\frac{T_{WO}}{T_W}\right)^w \left(\frac{V_a}{V_{BASE}}\right)^v\right] \tag{10}$$

$$f_L(z) = \left(K_L \cdot \frac{1}{B_{BNK} \cdot L_{BNK}}\right) \times \left[A_1 h^{A2} \exp\{-A_3(T-T_W)\}\left(\frac{T_{WO}}{T_W}\right)^w \left(\frac{V_a}{V_{BASE}}\right)^v\right] \tag{11}$$

When the valves of the cooling water banks are flow control valves, the values $F_{Ui}^{REF}$ and $F_{Li}^{REF}$ represented by the expression (9) are given upper/lower limits such as the rated flow rate as upper limit and zero as lower limit, and these values are outputted to lower order controller as directed values.

In the case where the valves of the cooling water banks are opening/closing valves, if the values $F_{Ui}^{REF}$ and $F_{Li}^{REF}$ are larger than the rated flow rate, the valves are full-opened. On the other hand, if the values $F_{Ui}^{REF}$ and $F_{Li}^{REF}$ are smaller than the rated flow rate, either one of the valves is closed. In general, one or two units of variable flow rate bank(s) are provided to make finer control, thereby achieving the finer enough flow rate control.

Figure 2:
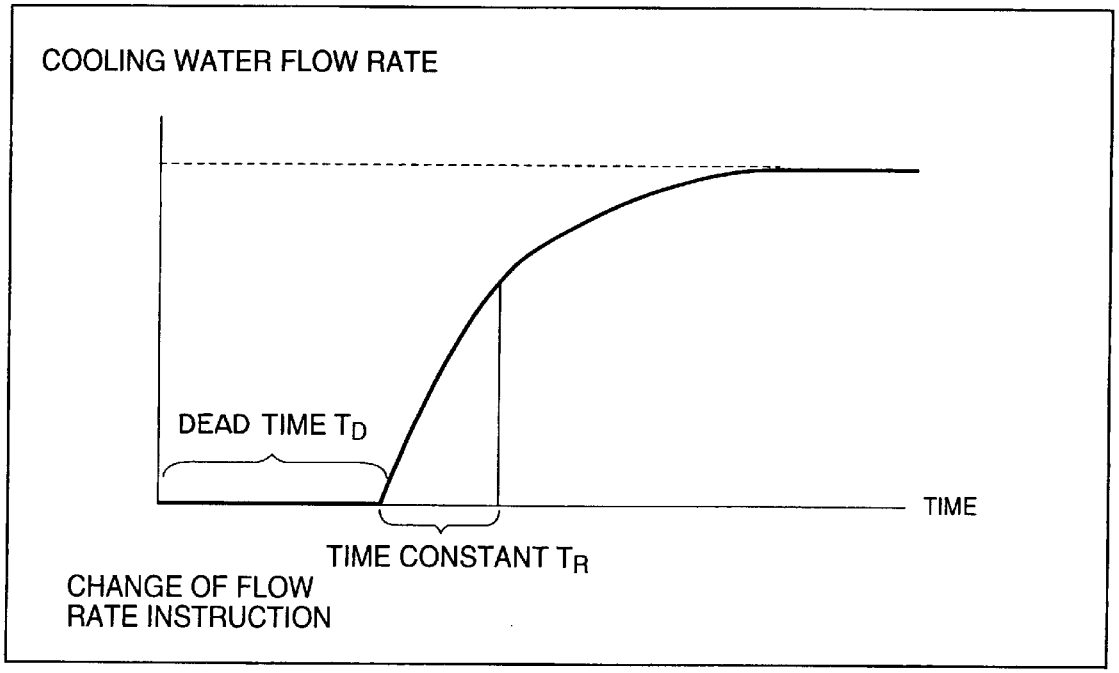
FIG. 2 is a curve showing a response delay of cooling water for a directed flow rate, to explain the operation of the embodiment shown in FIG. 1.

Now, detailed operation of the material temperature prediction means 13 will be described as follows:

In the case where the valves of the cooling water banks are flow control valves, response as shown in FIG. 2 is typical. When dead time $T_D$ elapsed after the point of time when flow rate directed value has been changed, the flow rate begins to change, and finally reaches 63% of the flow rate directed value at the first-order delay constant $T_R$. As for the flow rate response, provision of a flowmeter at the vicinity of the respective valves may decide the dead time $T_D$ and the delay time constant $T_R$, but, generally no flowmeter is provided. Then, following expression (12) is assumed to predict actual flow rate:

$$F^{CAL}(nT_S) = \frac{T_R}{T_S + T_R}F^{CAL}\{(n-1)T_S\} + \frac{T_S}{T_S + T_R}F^{REF}(nT_S - kT_S) \tag{12}$$

where $F^{CAL}$: predictive calculation value for actual flow rate $F^{REF}$: flow rate directed value $T_S$: control period n: the n-th control timing (present time)

k: coefficient approximated by using dead time $T_D = k \times T_S$.

Further, calculations in the case where closing valves are used at cooling banks to control cooling water flow can be dealt with or covered by making the delay time constant $T_R$ equal to zero. For temperature calculations, use of $F^{CAL}$ may achieve higher accuracy.

Figure 3:
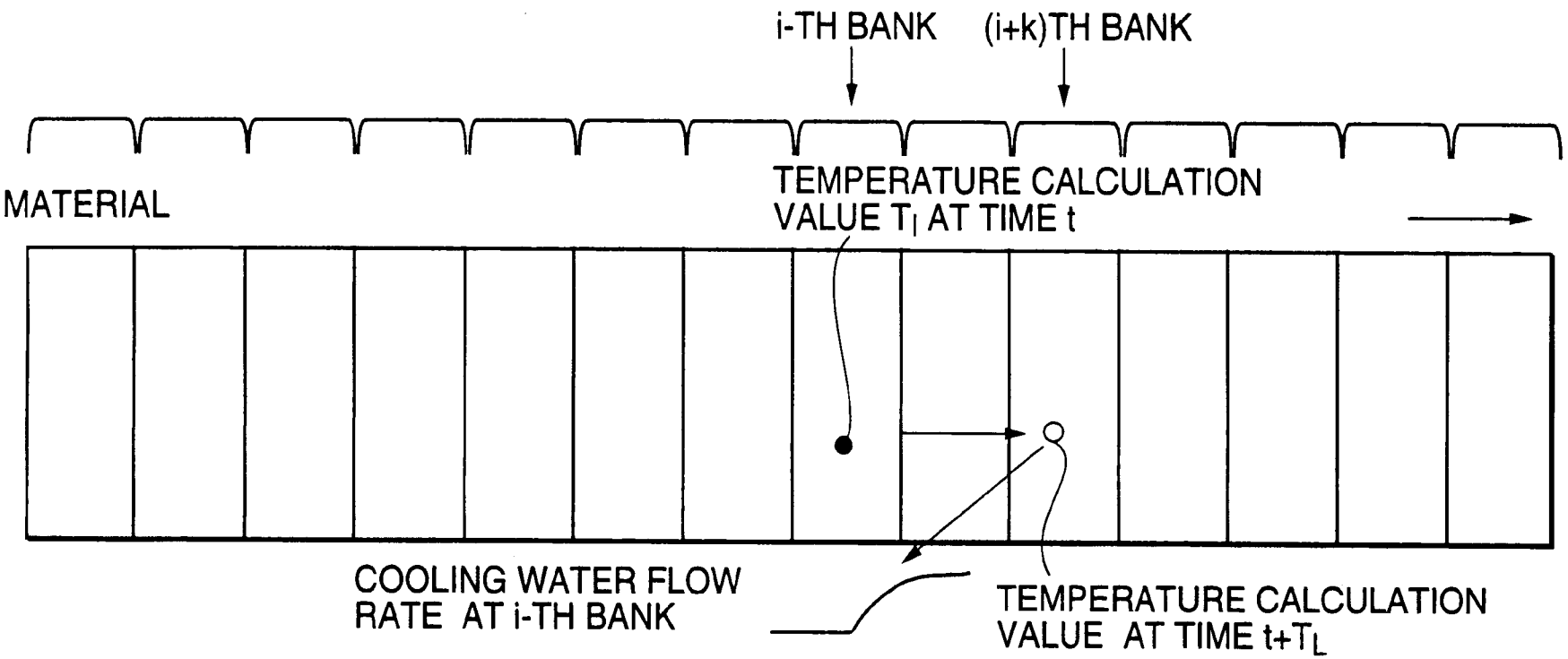
FIG. 3 is an illustration showing the relation between cooling banks and material cooling units in the case where response delay is not corrected, to explain the operation of the embodiment shown in FIG. 1.

As such, often there may be response delay before flow rate instructions realize the purpose, so that intact use of current temperature when performing the calculation of flow rate instruction in the approximation (9) may aggravate cooling controllability. For example, in FIG. 3, let us assume that the temperature of the i-th bank at time "t" is calculated to be $T_i$. If this temperature should be used as it is for the calculation of flow rate instruction to operate the valve, the desired flow rate can be essentially obtained at time $(t+T_L)$. (Here, typically $T_L$ can be replaced by $T_D+T_R$.) At this point of time, a segment of the strip locating at the i-th bank at time "t" has already reached the (i+1) th bank, thus resulting in poor controllability.

Figure 4:
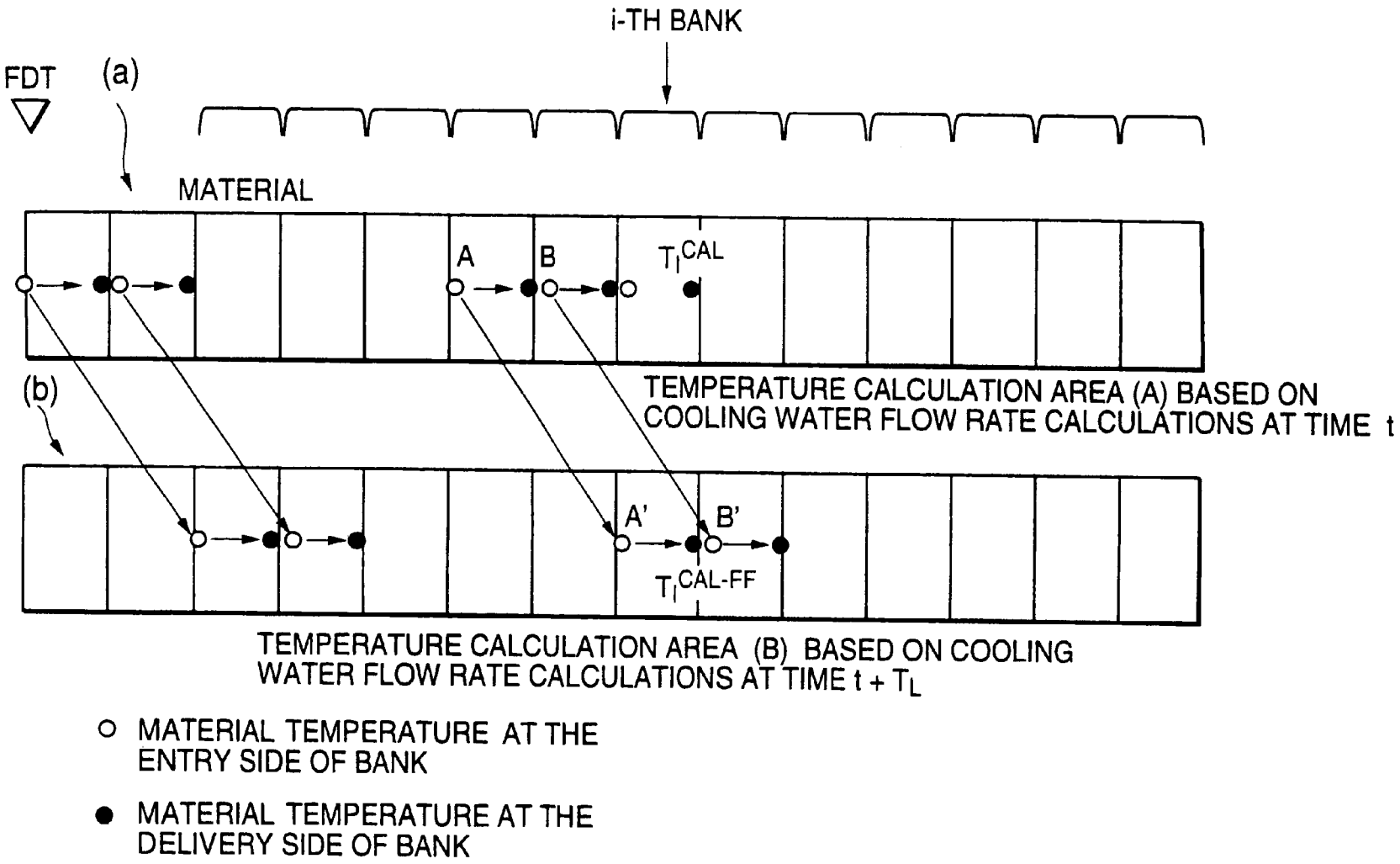
FIG. 4 is an illustration showing the concept of the response delay correction made by the material temperature prediction means constituting the embodiment shown in FIG. 1.

Such being the case, the material temperature prediction means 13 calculates material temperatures at each bank, considering the actual cooling water flow rate measurements. Now, this operation will be described in detail referring to FIG. 4:

The material temperature prediction means 13 has two temperature calculation areas; (1) an area (a) for making real time calculation of temperatures at every moment, and (2) an area (b) for correcting the influence of time delay. With the temperature calculation area (a), temperatures are calculated using the flow rate predictions represented by the expression (12), and the calculated temperatures are stored in the area (a). On the other hand, with the temperature calculation area (b), the temperatures at $(t+T_L)$ are stored in the area (b). Here, $T_L$ is delay time. A material cooling unit or segment which reaches the i-th bank at $(t+T_L)$ can be easily determined based on material transfer speed and bank length. Therefore, let us assume that the two points are point A which locates at the entry side of a bank, and point B which locates at the delivery side of the bank. The material temperature at point A' (refer to FIG. 4) can be predicted considering the cooling effect to which the segment at point A is subject for a time duration of $T_L$.

The temperature $T_i^{CAL\text{-}FF}$ of the i-th bank which is used for calculation of the expression (6) in the feed-forward control means 18*a*, 18*b*, 18*c*, . . . uses temperature calculations stored in the temperature calculation area (b). The temperature $T_i^{CAL\text{-}FF}$ is a temperature which makes cooling water condition to achieve the predetermined instruction values, when the temperature of the i-th bank have been $T_i^{CAL\text{-}FF}$, time $T_L$ later.

Figure 5:
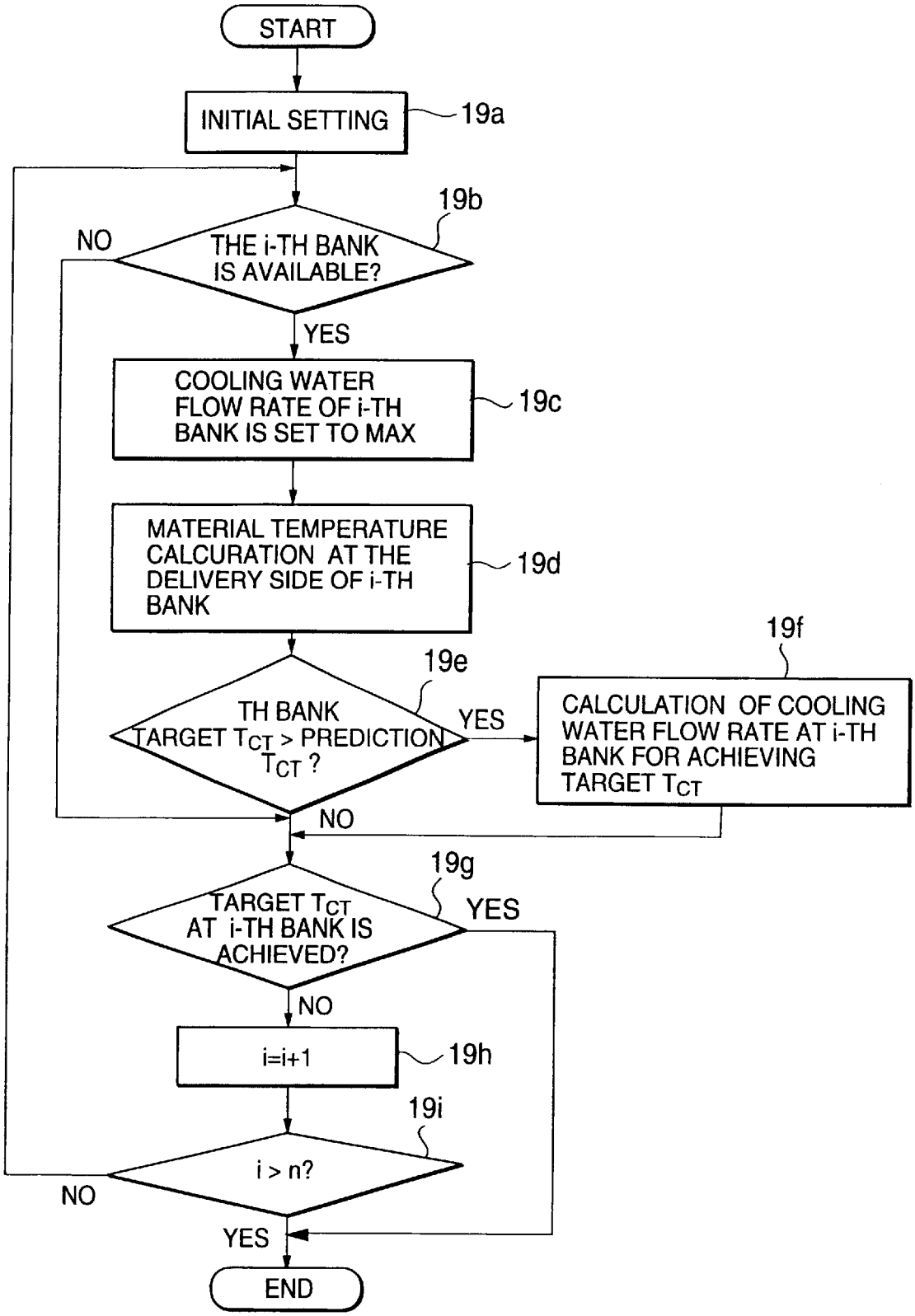
FIG. 5 is a flow chart showing the operational procedures of the cooling water initial flow rate setting means constituting the embodiment shown in FIG. 1.

Such control as described above can correctly compensate the response delay of cooling water. The cooling water initial flow rate setting means 11 in FIG. 1 makes the initial flow rate setting, which intends to previously flow cooling water so as to compensate such possible time delay of cooling water as described above. Based on the similar concept to the feed-forward control, initial flow rate is set according to, for example, the operational procedures step 19*a* to step 19*i* shown in the flow chart in FIG. 5. In this connection, according to the invention, the cooling water initial flow rate setting means 11 is not indispensable requisite, but can be substituted by the combination of the feed-forward control means 18*a*, 18*b*, 18*c*, . . . and the material temperature prediction means 13.

Figure 6:
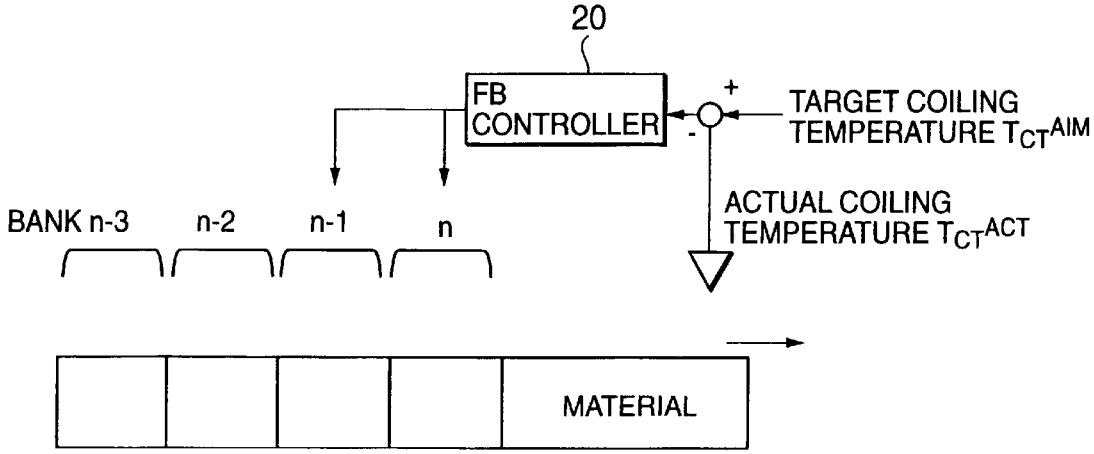
FIG. 6 is an illustration showing the detail of the feedback control means constituting the embodiment shown in FIG. 1.

Now, the feedback control means 17 has such configuration as shown in FIG. 6. The feedback control means 17 measures material coiling temperature which is regarded as actual coiling temperature $T_{CT}^{ACT}$ . The feedback control means 17 calculates a deviation of the actual coiling temperature $T_{CT}^{ACT}$ from target coiling temperature $T_{CT}^{AIM}$ The feedback controller 20 consists of PI control element or PID control element. First, the bank (numbered as "n") nearest to the coiling pyrometer 3 is selected to set cooling water flow rate. When the cooling water flow rate set by the bank "n" is insufficient, upstream banks "n−1", "n−2", . . . are selected as necessarily. In some cases, to compensate dead time due to strip transfer from the downstream bank "n" up to the coiling pyrometer 3, the feedback controller 20 may include a dead time compensation function such as Smith method. At the bank(s) serving also as feedback control, sign of manipulated variables may happen to be plus or minus, so that it is general routine that lower valves are opened at the initial setting.

Now, description will be made for the temperature model learning means 15:

The above-described temperatures are assumed to have a uniform temperature distribution in the thickness direction of the strip. In fact, the material is hot at the center in the thickness direction, and rather cold at the surface. The differential equation (1) must treat the average temperature of the strip, and consideration of different temperatures in the thickness direction can expect higher accuracy of calculations. Especially, thicker material may have a significant temperature difference between the surface and the center, so that consideration of temperature distribution in the thickness direction is effective.

Figure 7:
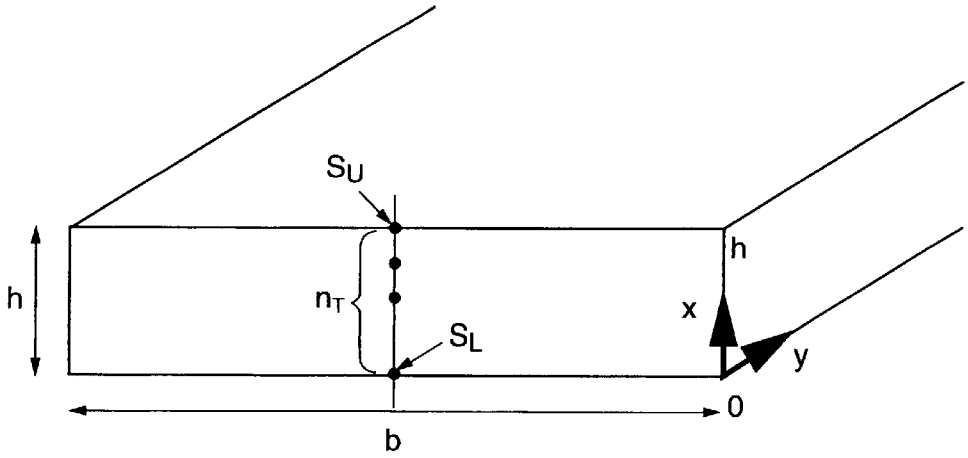
FIG. 7 is an illustration showing how to calculate the strip temperature according to the embodiment shown in FIG. 1.

The temperature distribution of the thickness direction is obtained by solving following first-order non-steady heat conduction equations (13A) and (13B):

$$c\rho\frac{\partial T}{\partial t} = \lambda\frac{\partial^2 T}{\partial t^2} \tag{13A}$$

$$T = T(x, t) \tag{13B}$$

where $\lambda$ is a coefficient of heat conductivity. FIG. 7 shows how to take the position of the coordinates and the relation of the three dimensions of the strip with the coordinates.

Equations (13A) and (13B) represent a relation between temperature T, time t and a position x of a point upward away from the bottom surface or the standard surface. Here, substituting for (because of thermal diffusivity $a=\lambda/(c\rho)$, we have equation (14).

$$\frac{\partial^2 T}{\partial t^2} = \frac{1}{a}\cdot\frac{\partial T}{\partial t} \tag{14}$$

The above equation (14) is transformed into a differential-difference equation, which may be numerically solved, but it can be analytically solved by way of variable separation method as follows: That is, using equation (15), boundary conditions are given as follows:

$$T(x,t)=\exp(-aq^2t)\times\{A\sin(qx)+B\cos(qx)\} \tag{15}$$

Boundary conditions are:

1) temperature T (at point $S_L$)=$T_{EL}$, at t=0 and x=0
2) temperature T (at point $S_U$)=$T_{EU}$, at t=0 and x=h
3) average temperature $T_{AVE}$ in the thickness direction at t=0 is identical to the sum of the measurement $T_{FED}$ at FED 2 and <$T_{FED}$, and the average temperature. $T_{AVE}$ is uniform in the thickness direction.

Under these above conditions, A and B in the equation (15) are solved as following expressions (16A) and (16B):

$$B = T_{EL} \tag{16A}$$

$$A = \frac{T_{EU} - T_{EL}\cos(qh)}{\sin(qh)} \tag{16B}$$

Further, assuming that surface temperatures $T_E$, $T_{EL}$ and $T_{EU}$ are all equal, following equality (17) can be obtained.

$$T_{AVE} = T_{FDT} + \Delta T = \frac{2}{hq}T_E\sin(qh) \tag{17}$$

The above equality (17) can be transformed into a following equality (18):

$$(qh)\sin(qh) = \frac{2T_E}{T_{AVE}}\{1-\cos(qh)\} \tag{18}$$

Calculation of q from the equality (18) results in the solution of z sin z=b {1−cos(z)} when z and b are replaced respectively by hq and $2T_E/T_{AVE}$, but generally this cannot be solved analytically.

Here, first, neglecting higher order terms of series expansion forms of sin function and cos function, sin (z) and cos (z) are approximated into the following expressions (19A) and (19B):

$$\sin(z) = z - \frac{z^3}{3!} + \frac{z^5}{5!} \tag{19A}$$

$$\cos(z) = 1 - \frac{z^2}{2!} + \frac{z^4}{4!} - \frac{z^6}{6!} \tag{19B}$$

Then, using the approximations, approximate solution of Z can be obtained as an equation of the third degree or using the Newton-Raphson method and other numerical solution.

The above procedure gives A, B and q, thus resulting in a determination of average temperature $T_{AVE\text{-}h}$ in the thickness direction using the following equality (20):

$$T_{AVE-h} = \frac{1}{h}\int_0^h T(x,t)\,dx = \frac{a_1}{qh}\{1-\cos(qh)\} + \frac{a_2}{qh}\{\sin(qh)\} \tag{20}$$

Calculation of material temperature using the average temperature in the thickness direction can enhance the calculation accuracy for thicker materials.

Now, the temperature model learning means 15 carries out such an operation as follows:

Model learning is conducted at water-cooling. First of all, consideration is directed to a possible temperature change caused only by water-cooling. This change can be represented by following equation (21):

$$\frac{dT}{dt} = -\frac{\alpha_U + \alpha_L}{c\rho h}(T - T_W) \tag{21}$$

The general solution of equation (21) is such expressions (22A) and (22B) as follows:

$$T = C\,\exp(-a_0 t) + T_W \tag{22A}$$

$$a_0 = \frac{\alpha_U + \alpha_L}{c\rho h} \tag{22B}$$

From the expressions (22), the material temperature $T_i$ at the delivery side of the i-th bank can be expressed by following expression (23):

$$T_i = (T_{i-1} - T_W)\exp(-a_{0i}t_{Bi}) + T_W \tag{23}$$

where $T_{i-1}$: material temperature at the entry side of the i-th bank (Here, assumption is made that the above temperature is equal to the one at the delivery side of the (i−1)th bank)

$t_{Bi}$: material passing time through the i-th bank.

Using the expression (23), strip temperature can be calculated. First, the strip temperature at the entry side of ROT 10 or of the first bank is obtained, and then the temperature at the delivery side of the first bank or the entry side of the second bank is obtained. This calculation is repeated until reaching the coiler 5, thus obtaining the temperature $T_{CT}$ of the strip just entering the coiler 5 as following expression (24):

$$T_{CT} = (T_0 - T_W)\exp(a_{01}t_{Bi} - a_{02}t_{B2} - \cdots - a_{0n-1}t_{Bn-1} - a_{0n}t_{Bn}) + T_W \tag{24}$$

Here, the model learning expressions (24) and (25) for $T_{CT}^{ACT}$ and (26) and (27) for $T_{CT}^{CAL}$ according to the prior art is shown as follows:

$$T_{CT}^{ACT} = (T_0 - T_W)\exp(-a_1^A t_{B1} - a_2^A t_{B2} - \cdots - a_n^A t_{Bn}) + T_W \tag{25}$$

$$-a_1^A t_{B1} - a_2^A t_{B2} - a_n^A t_{Bn} = \ln\left(\frac{T_{CT}^{ACT} - T_W}{T_0 - T_W}\right) \tag{26}$$

$$T_{CT}^{CAL} = (T_0 - T_W)\exp(-a_1^C t_{B1} - a_2^C t_{B2} - \cdots - a_n^C t_{Bn}) + T_W \tag{27}$$

$$-a_1^C t_{B1} - a_2^C t_{B2} - \cdots - a_n^C t_{Bn} = \ln\left(\frac{T_{CT}^{CAL} - T_W}{T_0 - T_W}\right), \tag{28}$$

where $a^A$ : actual value of $a_0$ $a^C$ : calculated value of $a_0$.

Here, let us assume that (1) time $t_{bi}$ for passing through each bank is constant; (2) $T_0 = T_{FDT}$; and (3) coefficients a at each bank is expressed by following expressions (29A) and (29B):

$$na^A = \sum_{i-1}^{a} a_i^A \tag{29A}$$

$$na^C = \sum_{i-1}^{n} a_i^C \tag{29B}$$

Divisional calculation of expression (26) by expression (28) obtains following expressions (30A) and (30B):

$$a^A = a^C \phi_{CTC} \tag{30A}$$

$$\phi_{CTC} = \frac{\ln\left(\frac{T_{CT}^{CAL} - T_W}{T_0 - T_W}\right)}{\ln\left(\frac{T_{CT}^{CAL} - T_W}{T_0 - T_W}\right)} \tag{30B}$$

In other words, $\phi_{CTC}$ is found to be the learning term in this case. For all segments of one particular piece of strip which have been already water-cooled, or for every water-cooled learning point, the $\phi_{CTC}$ is calculated. But, to minimize an influence due to noise and the like, the expression (30B) is smoothed into the following expression (31), so that it should be reflected to the water-cooling term in the equation (1) for the next entering strip:

$$-\frac{\alpha_U + \alpha_L}{c\rho h}\phi_{CTC}(T - T_W) \tag{31}$$

The expression (31) can be said to follow a multiplying coil-to-coil learning. This method intends to make a batch processing of the cooling state of the two strips moving in between FDT 2 and CT 3, utilizing the relation of the entry side of temperature $T_{FDT}$ and the delivery side of temperature $T_{CT}$, viewed from ROT 10. In general, it is known that, as material cooling is progressing, cooling effect will build up higher, so that this method may not be preferable from the viewpoint of accuracy in handling the model. Therefore, in stead of this method, a following method is conceived:

First, the following expression (32) is obtained by dividing expression (25) by expression (27):

$$\frac{T_{CT}^{ACT}-T_W}{T_{CT}^{CAL}-T_W}=\frac{(T_0-T_W)\exp(-a_1^A t_{B1}-a_2^A t_{B2}-\cdots-a_{0n}^A t_{Bn})}{(T_0-T_W)\exp(-a_1^C t_{B1}-a_2^C t_{B2}-\cdots-a_n^C t_{Bn})} \tag{32}$$

When taking the logarithm of both sides in expression (32), following expression (33) is obtained:

$$-a_1^A t_{B1}-a_2^A t_{B2}-\cdots-a_{0n}^A t_{Bn}-(-a_1^C t_{B1}-a_2^C t_{B2}-\cdots-a_n^C t_{Bn})=\ln\left(\frac{T_{CT}^{ACT}-T_W}{T_{CT}^{CAL}-T_W}\right) \tag{33}$$

For the expression (33), when the passing time $t_{Bi}$ at each bank is constant, assuming that following expressions (34A) and (34B) hold as to the coefficients of each bank, following expressions (35A) and (35B) are obtained:

$$na^A=\sum_{i=1}^{n} a_i^A \tag{34A}$$

$$na^C=\sum_{i=1}^{n} a_i^C \tag{34B}$$

$$a^A-a^C=-\frac{1}{n\,t_B}\ln\left(\frac{T_{CT}^{ACT}-T_W}{T_{CT}^{CAL}-T_W}\right) \tag{35A}$$

$$\phi_{ACTC}=\frac{c\rho h}{nt_B}\ln\left(\frac{T_{CT}^{ACT}-T_W}{T_{CT}^{CAL}-T_W}\right) \tag{35B}$$

Here, $nt_B$ is equal to the passing time of the strip from the installation position of FDT 2 at the entry side of ROT 10 to the installation position of CT 3. The $\phi_{ACTC}$ in the expression (35B) comes up to be a new learning term. For all segments of one particular piece of strip which have been already water-cooled, or for every water-cooled learning point, the learning term $\phi_{ACTC}$ is calculated. But, the expression (35B) is smoothed into the following expression (36), so that it should be reflected to the water-cooling term in the equation (1) for the next entering strip:

$$-\frac{(\alpha_U+\alpha_1+\phi_{ACTC})}{c\rho p}(T-T_W) \tag{36}$$

The expression (36) can be said to follow an additive coil-to-coil learning. The advantage of this additive coil-to-coil learning is that the learning of heat transfer coefficients at each bank can be made.

The expression (33) can be transformed into following expression (37):

$$-(a_1^A-a_1^C)t_{B1}-(a_2^A-a_2^C)t_{B2}-\cdots-(a_n^A-a_n^C)t_{Bn}=\ln\left(\frac{T_{CT}^{ACT}-T_W}{T_{CT}^{CAL}-T_W}\right), \tag{37}$$

$a_i$ is replaced by $-(a_i^A-a_i^C)$.

$$a_i=-(a_i^A-a_i^C) \tag{38}$$

Data are gathered for all segments of one particular piece of strip which have been already water-cooled, or for every water-cooled learning point. (The data are taken as data of m points.) Thus, m pieces of expressions (37) are obtained. Regression, to be made where the right side of the expression (37) is regarded as dependent variable and t B1, t B2, . . . , t Bn are regarded as independent variables, can determine regression coefficient $a_i=a_i=-(a_i^A-a_i^C)$, where $$A_i=-\frac{\alpha_i^A}{c\rho h}+\frac{\alpha_i^C}{cqh} \tag{39A}$$

$$\alpha_i^A=\alpha_i^C-A_i c\rho h \tag{39B}$$

$$\phi_{ALTL}=-A_i c\rho hp \tag{39C}$$

But, the expression (35B) is smoothed into the following expression (40), so that it should be reflected to the water-cooling term in the equation (1) for the next entering strip:

$$-\frac{(\alpha_{Ui}+\alpha_{1i}+\phi_{ALTLi})}{c\rho h}(T_i-T_W) \tag{40}$$

Learning using the expression (39) makes regression analysis taking the residence time of a strip at all the cooling banks as independent variable, thereby resulting in an adequate number of data to be stored. After judgment has been made for good regression accuracy or reliance of the obtained data, the data should be reflected to the learning. Therefore, the learning term is to be calculated for every identical lot (a package or assembly of identical steel type or size), and then be smoothed. That is why this learning is said an additive intra-lot learning. This method can make the learning of heat transfer coefficient for every bank, thus advantageously capable of learning difference in heat transfer coefficient due to material temperature.

In this connection, it is not necessarily to select one independent variable so as to correspond to every bank, but several continued similar banks may be grouped into one, to select a single independent variable for that group. For example, depending on the nature of variables, if the number of banks are twenty, four pieces of continued similar banks may be grouped into one package so as to select five independent variables, thus significantly simplifying the calculation without causing significant loss of accuracy.

Now, detailed description will be made for the target temperature setting means 12:

The target temperature setting means 12 gives every bank their target temperatures. The target temperature for the coiling temperature $T_{CT}$ is given based on product specification and other factors. It is very difficult to uniquely determine the pattern of temperatures which take place on all the way of ROT 10. The reason is that, the desirable target temperature pattern must be decided while making repetitive calculations whether the expected final temperature of a strip detected by CT 3 is allowable or not, considering temperature characteristics at all the banks.

Therefore, first, target temperatures are not decided for all the banks, but are decided only for the position closer to the coiler 6 and positions not subjected to positive water-cooling, thereby extremely minimizing the necessary number of target temperatures.

Figure 8A:
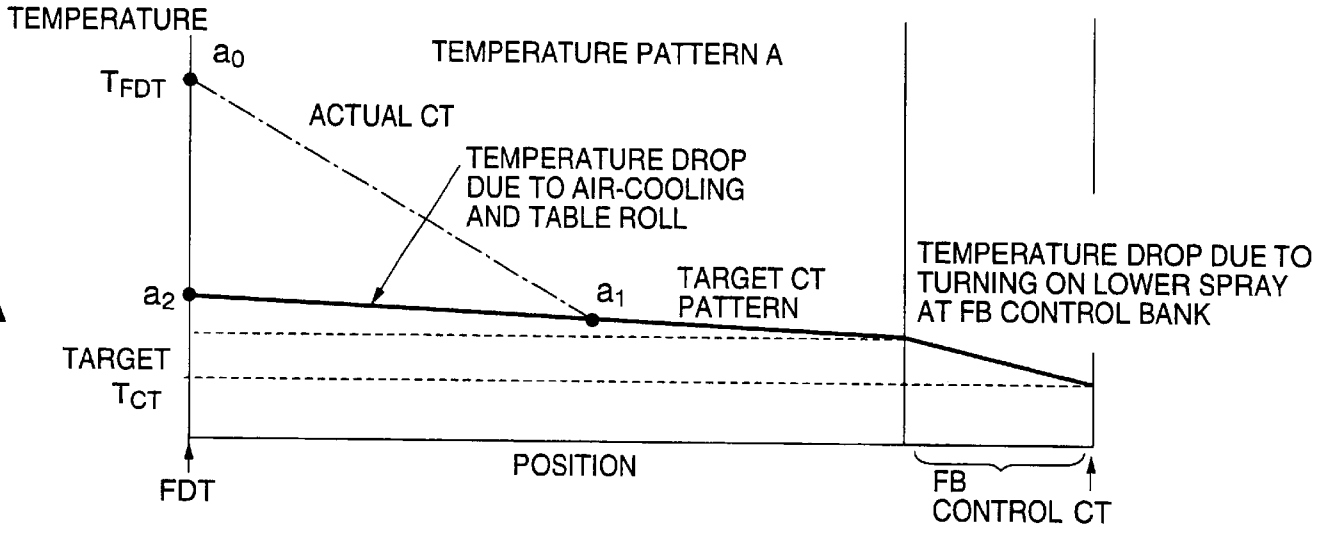
FIGS. 8A and 8B are illustrations showing functional performances of the target temperature setting means constituting the embodiment shown in FIG. 1.
Figure 8B:
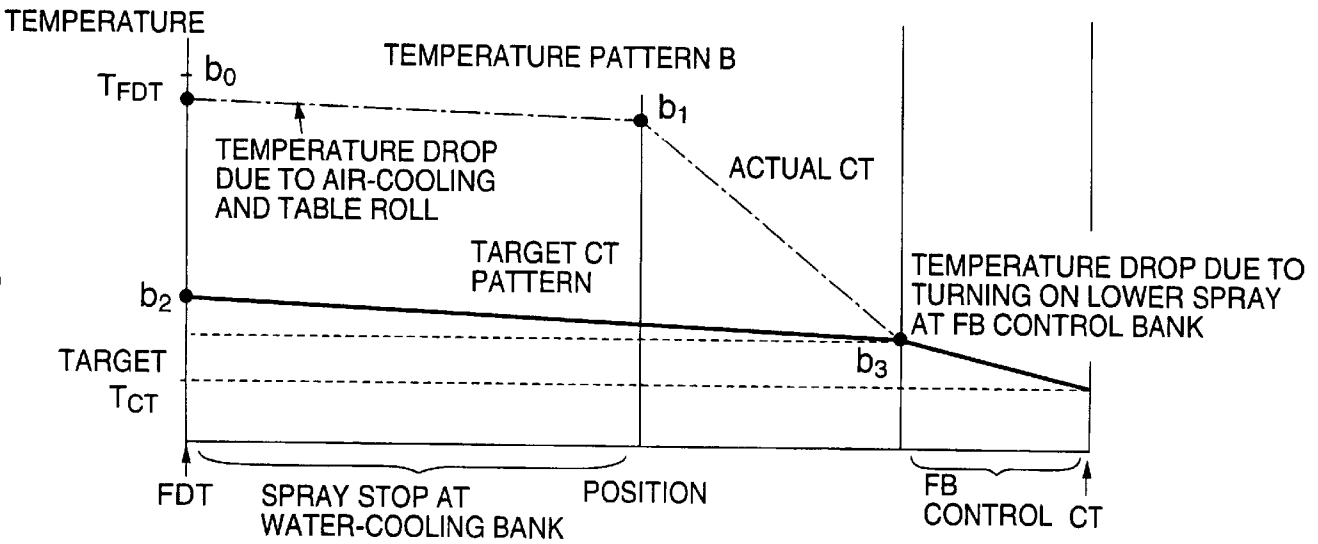

In FIGS. 8A and 8B, the target coiling temperature pattern is shown by a bold line. The temperature pattern A shown in FIG. A shows the case where air-cooling is made at the early stage while positive water-cooling is made at the later stage.

For this type of temperature pattern A, it is rather difficult to decide target temperature drop from point $a_0$ to point $a_1$, because what bank the point $a_1$ is to be located at must be determined by calculation.

In this connection, when taking the application range of the target temperature pattern from the point $a_2$ up to the point $a_1$, it is not necessarily needed to previously fix the position of the point $a_1$. Here, if feed-forward control should be used, such a flow rate as to be only lowered would be determined, but there is a limitation for the maximum flow rate actually obtainable, thus resulting in a limited temperature range to be lowered. Actually, it suffices to adjust flow rate so as only to achieve the target temperature when the temperature under consideration (???) entered close to the point $a_1$, thereby eliminating the need for specifying what a path should be traced, thus resulting in a simplified determination of the target temperature.

As with the case of temperature pattern B as shown in FIG. 8B, determination of temperature pattern B is not so simple as in the case of the temperature pattern A, but reverse calculation of temperature from point $b_3$ to the upstream direction can obtain a point $b_1$ up to which water-cooling should be inhibited by control, thus resulting in successful dealing with this determination problem.

Now, detailed operation of the target temperature correction means 16 will be described as follows:

To achieve the proper target coiling temperature depending on products, the target temperature correction means 16 manipulates for a limited time the target value of coiling temperature to be used for control. For example, the target temperature correction means 16 measures the temperature of strip cooling segment right under CT3, to compare the measurement with the target value. When they do not coincide with each other, the once set target coiling temperature is changed $\Delta T_{CT}$ for purpose of control. The $\Delta T_{CT}$ is calculated using following expressions (41A), (41B) and (41C):

$$\Delta T_{CT}=K_{TA}(T_{CT}^{REF}+T_{CT}^{ACT}) \quad (41A)$$

$$\text{If } |\Delta T_{CT}|<\Delta T_{CT}^{LMT}, \text{ then } \Delta T_{CT}=0 \quad (41B)$$

$$T_{CT}^{REF}=T_{CT}^{REF}+\Delta T_{CT} \quad (41C)$$

where $K_{TA}$: gain $T_{CT}^{REF}$: target coiling temperature for control purpose $T_{CT}^{ACT}$: actual coiling temperature measured by CT $\Delta T_{CT}^{LMT}$: upper and lower limits to prevent the target value from being changed too frequently.

To confirm an effect due to the change, every time when the target value is changed, waiting the strip cooling segment just coming at the entry side of ROT 10 to advance right under the CT 3, the expressions (41A), (41B) and (41C) are calculated, to change the preset target temperature.

Figure 9:
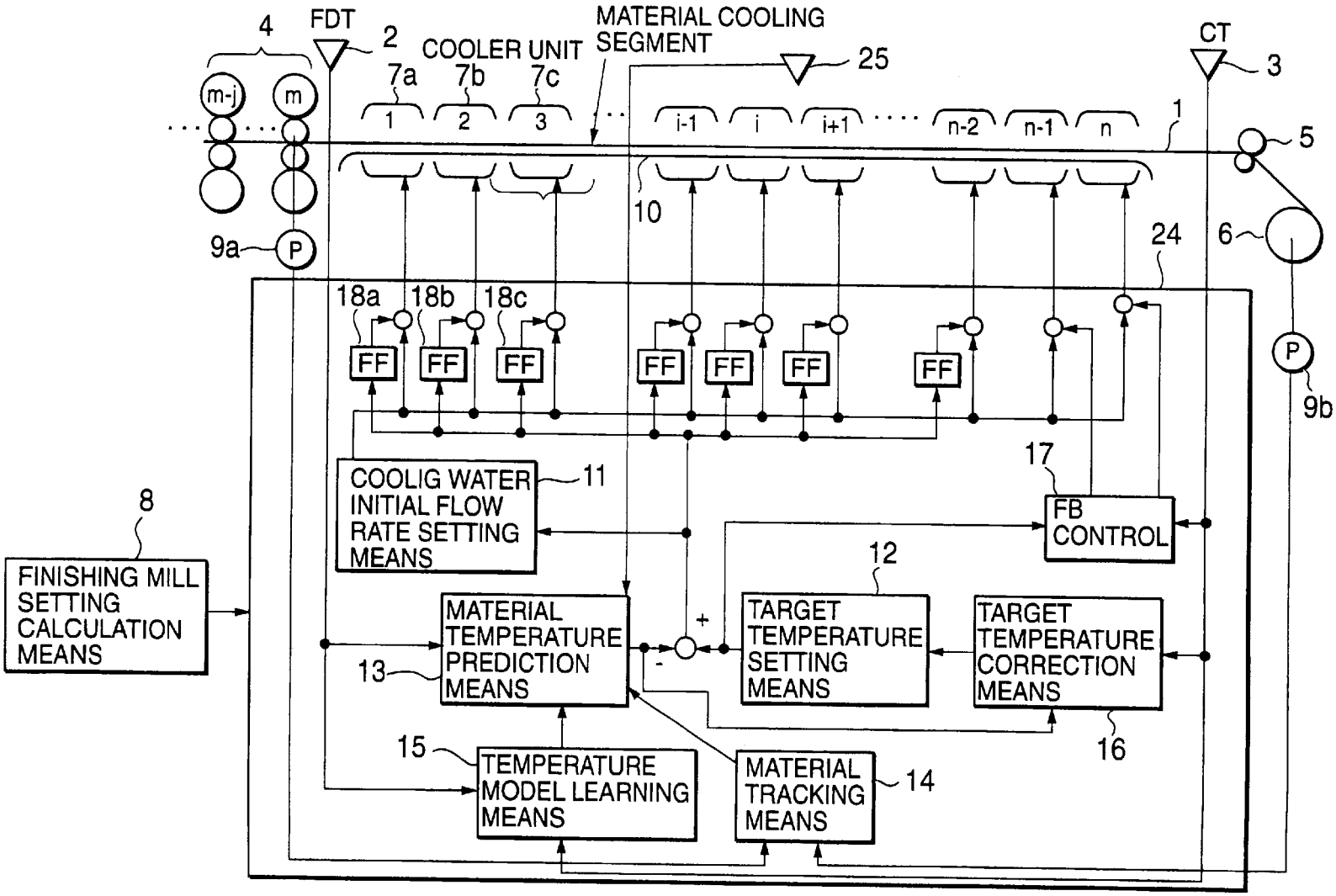
FIG. 9 is a schematic block diagram showing another embodiment of the temperature control system to carry out the temperature control method according to this invention, along with an application device.

FIG. 9 is a schematic block diagram showing another embodiment of the coiling temperature control system to carry out the coiling temperature control method according to the invention, along with an application device; according to this embodiment, one or more intermediate pyrometers 25 are installed on the way of ROT 10 to measure the temperature(s) of a segment(s) just coming under the intermediate pyrometer(s) 25. The coiling temperature control system evaluates a deviation of the measurements from expected temperatures, so as to correct the temperature model. Here, further description will be made assuming that one intermediate pyrometer 25 is installed at the delivery side of the i-th bank:

Now, the j-th strip cooling segment from the head end of the strip comes just under the i-th bank. The calculation value of temperature drop (according to the temperature model) taking place at the time when the segment advances to the (i+1)th bank is named ΔT. The ΔT is determined by making an adequate integration of the differential equation (1).

After determination of temperature drop ΔT, the ΔT must be corrected, and the correction value$\Delta T^{MOD}$ is obtained using following expressions (42A) and (42B):

$$\Delta T^{MOD}=K_{MT}(T_{iMT}^{ACT}\cdot T_i^{CAL}) \quad (42A)$$

$$T_i^{CAL}=T_i^{CAL}+\Delta T^{MOD} \quad (42B)$$

where $T_{iMT}^{ACT}$: temperature measurements of the j-th strip cooling segment from head end of strip measured by intermediate pyrometer 25

$T_i^{CAL}$: temperature calculations of the i-th strip cooling segment advancing to the delivery side of the i-th bank calculated according to temperature model $K_{MT}$: gain.

In this connection, using the temperature measurements measured by the intermediate pyrometers 25, a feedback control which feed-backs operation data from the i-th bank to the upstream banks, or a feed-forward control which feed forwards operation data from the i-th bank to the downstream banks may be configured.

The temperature measurements obtained by the CT 3 or the intermediate pyrometers are for the surface temperature of the segments. On the contrary, the differential equation (1) expressing the temperature model deals with the average temperature of a strip segment. Therefore, the measurements by CT 3 or the intermediate pyrometers 25 is taken as the surface temperature $T_E$ ($=T_{EL}=T_{EU}$), and the surface temperature $T_E$ obtained is used to calculate the average temperature in the thickness direction using the expression (20), and the calculations can be used for other temperature calculation and the control operation, thereby achieving successful temperature calculation and control for thicker strips too.

What is claimed is:

1. A coiling temperature control method for cooling a strip rolled by a hot rolling mill using a plurality of coolers installed on a run out table at the delivery side of the hot rolling mill to control the temperature of the strip in front of a coiler to a predetermined target temperature, said method comprising the steps of:

conceptually dividing the rolled strip to form several cooling units or segments in the direction of strip advancing in serial cooling banks that include a plurality of coolers;

predicting the temperatures of the strip segments; and controlling said predicted temperatures so as to coincide with predetermined target temperatures.

2. A coiling temperature control system for cooling a strip rolled by a hot rolling mill using a plurality of coolers installed on a run out table at the delivery side of the hot rolling mill to control the temperature of the strip in front of a coiler to a predetermined target temperature, said system comprising:

temperature prediction means for predicting temperatures of rolled strip cooling units or segments which are formed by conceptually dividing the rolled strip in the direction of strip advancing in serial cooling banks that include a plurality of coolers; and temperature control means for controlling the temperatures of every strip cooling segment predicted by said temperature prediction means so as to coincide with a predetermined target temperatures.

3. The coiling temperature control system as claimed in claim 2, further comprising:

strip temperature prediction means for predicting on a real time basis the temperatures of said strip cooling segments at the time when the strip cooling segments locate in said relevant cooling banks; and feed-forward control means for controlling the cooling water flow rates of said cooling banks so that the temperatures predicted by said temperature prediction means coincide with the predetermined target temperatures.

4. The coiling temperature control system as claimed in claim 3, wherein said strip temperature prediction means predicts such a temperature as to compensate a distance of the segments advancing in a response delay time duration elapsed before the cooling water flow rates of said cooling banks reach respective pre-ordered flow rates, and sets the predicted compensation temperature to said feed-forward control means.

5. The coiling temperature control system as claimed in claim 2, wherein a temperature model for describing the cooling of rolled strip is used to predict the temperatures of said strip cooling units, said temperature model includes at least of heat conduction terms, among a heat conduction term from the strip to cooling water, a heat buildup term due to phase transformation, a heat radiation term from the strip, and a heat conduction term to peripheral bodies except cooling water from the strip, the temperature of the strip to be used in said temperature model can use a representative or average temperature of the strip in the thickness direction thereof, which is obtained from an analytical solution of a first-dimensional non-steady thermal conduction equation.

6. The coiling temperature control system as claimed in claim 5, wherein as parameters which can describe thermal conduction coefficient to be used as thermal conduction term from the strip to the cooling water in the temperature model, at least cooling water flow rate, cooling water temperature, and the transfer speed and temperatures of the strip segments are included.

7. The coiling temperature control system as claimed in claim 5, wherein the temperature model to be used in said strip temperature prediction means is subject to correction by learning term calculated based on the actual data to be obtained from control operations, and as the learning term, at least one of a coil-to-coil learning term and a within-lot learning term is calculated.

8. The coiling temperature control system as claimed in claim 7, wherein said learning term segregates the thermal conductivity of the material cooling segments for each cooler or for each cooler unit group into which several cooler units are handled as a package, and learning is conducted for the thermal conductivity of said strip cooling unit for every segregation.

9. The coiling temperature control system as claimed in claim 2, further comprising temperature target setting means for tentatively giving the target temperatures set for every strip cooling segment as the actual temperatures just in the cooler units, and then recalculates the target temperatures as a function which includes a total temperature reduction due to cooling factors other than water-cooling which is obtained by integration from the coiling pyrometer side toward upstream side, and the coiling target temperature.

10. The coiling temperature control system as claimed in claim 9, wherein at the initial setting, the coiling target temperature for the purpose of control is set identical to a coiling target temperature proper to a product or strip, and said system further comprising temperature target correction means, said temperature target correction means, when comparison shows that the coiling target temperature for purpose of control is higher than the actual temperature of the strip cooling segment transferred down to the coiling pyrometer, increasing the coiling target temperature for purpose of control, while, in a lower case, decreasing the coiling target temperature for purpose of control.

11. The coiling temperature control system as claimed in claim 2, further comprising:

at least one intermediate pyrometer for measuring the material temperatures in midway on the run out table, and prediction temperature correction means for correcting the predicted material temperatures, using the deviation of actual measurements of the intermediate pyrometers from the predictive temperatures of the strip at the intermediate pyrometers.

12. The coiling temperature control system as claimed in claim 11, wherein at least in the case of a rolling strip with a particular thickness, mean temperatures in the thickness direction of a rolled strip which are obtained by analytically solving a first-dimensional non-steady thermal conduction equation are used as actual material temperatures measured by the respective pyrometers.

13. The coiling temperature control system as claimed in claim 12, wherein the particular thickness is greater than a predetermined thickness value, so as to take into consideration different temperatures in the thickness direction of the rolling strip.

* * * * *